US005197206A

United States Patent [19]

Shorten

[11] Patent Number: 5,197,206

[45] Date of Patent: Mar. 30, 1993

[54] SHOE, ESPECIALLY A SPORT OR REHABILITATION SHOE

[75] Inventor: Martyn R. Shorten, Portland, Oreg.

[73] Assignee: Tretorn AB, Helsingborg, Sweden

[21] Appl. No.: 707,872

[22] Filed: May 31, 1991

[30] Foreign Application Priority Data

May 31, 1990 [DE] Fed. Rep. of Germany ..... 9006176

[51] Int. Cl.[5] ..... A43B 13/20; A43B 13/18

[52] U.S. Cl. ..... 36/29; 36/28

[58] Field of Search ..... 36/28, 59 C, 29, 71, 36/3 B, 44, 143, 144; 428/116, 118; 5/435, 442, 444, 452, 455, 464, 476, 481

[56] References Cited

U.S. PATENT DOCUMENTS

| | | | |
|---|---|---|---|
| 532,429 | 1/1895 | Rogers . | |
| 1,559,532 | 10/1925 | Smith . | |
| 3,738,373 | 6/1973 | Glancy | 36/144 |
| 3,876,493 | 4/1975 | Gilmore | 36/71 |
| 4,241,465 | 12/1980 | Yarimie et al. | 5/452 |
| 4,291,080 | 9/1981 | Ely et al. | 428/116 |
| 4,472,890 | 9/1984 | Gilbert | 36/28 |
| 4,485,568 | 12/1984 | Landi et al. | 36/44 |
| 4,583,338 | 4/1986 | Sewell et al. | 428/116 |
| 4,970,807 | 11/1990 | Anderie et al. | 36/28 |
| 5,005,300 | 4/1991 | Diaz et al. | 36/28 |
| 5,084,987 | 2/1992 | Flemming | 36/28 |
| 5,092,060 | 3/1992 | Frachey et al. | 36/28 |

FOREIGN PATENT DOCUMENTS

| | | | |
|---|---|---|---|
| 513375 | 10/1939 | United Kingdom | 36/59 C |

*Primary Examiner*—Steven N. Meyers

*Attorney, Agent, or Firm*—Sixbey, Friedman, Leedom & Ferguson

[57] ABSTRACT

A shoe, especially a sport or rehabilitation shoe with a shoe sole with at least one insert part formed of a honeycomb body of elastic compressible material, and having honeycomb cells of which the central axes run at least approximately perpendicular to the plane of the sole provides the honeycomb cells, in an area under the heel bone, in a central portion of the honeycomb body with a greater surface area, when seen in top view, than honeycomb cells surrounding the central portion. Thus, the central part of the honeycomb body represents the actual damping part, while the edge area surrounding it, acts as a support for the heel edge part, having a controllable stiffness or restoring force. Furthermore, the surface area of the honeycomb cells decreases in radially outward directions from the center, and preferably, the honeycomb cells are arranged in rings about a largest central cell with the honeycomb cells of the rings being elongated in a circumferential direction about the central cell.

19 Claims, 2 Drawing Sheets

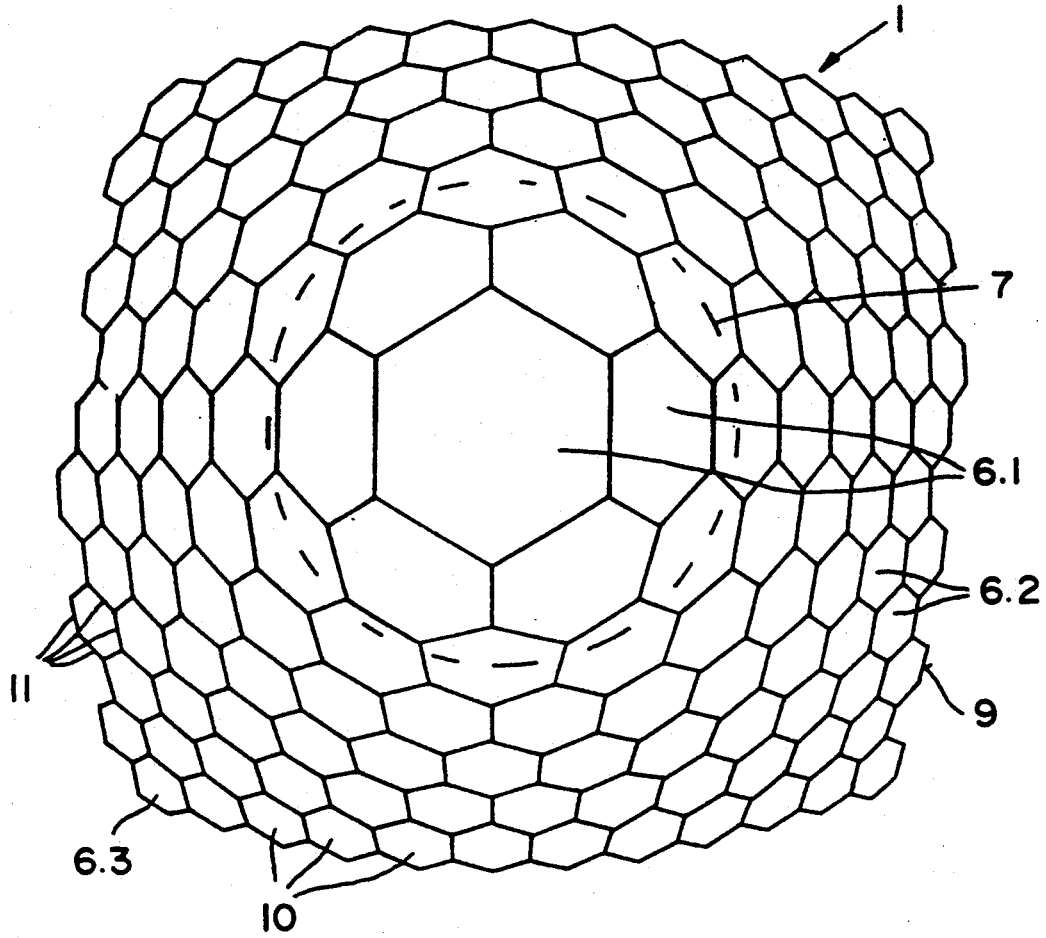
FIG. 1
FIG. 2
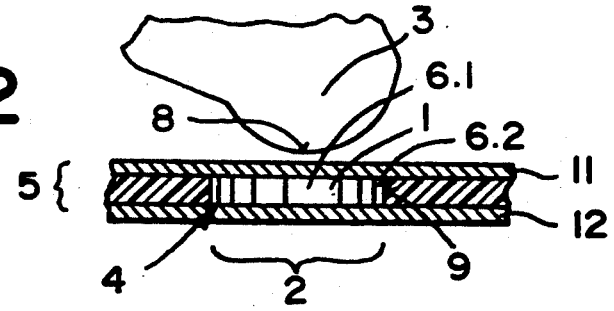
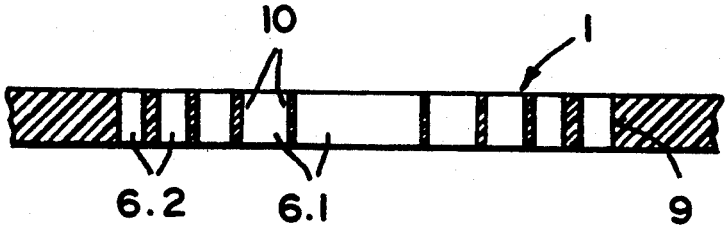
FIG. 3

SHOE, ESPECIALLY A SPORT OR REHABILITATION SHOE

BACKGROUND OF THE INVENTION

This invention relates to a shoe, especially a sport or rehabilitation shoe with a shoe sole with at least one insert part formed of a honeycomb body consisting of elastic compressible material, and having honeycomb cells of which the central axes run at least approximately perpendicular to the plane of the sole.

From U.S. Pat. No. 4,485,568, an insole for a shoe is known, which exhibits a honeycomb structure. The upper side of this insole consists of an air-permeable material and the underside of a thin backing. On the peripheral edge the honeycomb cells, which are applied between the foamed padding (upper side) and the thin backing, are at least partially open, since the honeycomb body is produced from undulating or meander-shaped strips glued together on the walls and then stretched so that honeycomb cells of longitudinally extended rectangular form result. Such honeycomb bodies, as a result of the laterally open edge honeycomb cells, have a greatly decreasing damping toward the edge, so that the restoring force of such a honeycomb body in the edge areas also tends almost toward zero. This is not favorably influenced or compensated for even by the upper side and underside joined on the edge. For an insole this result is also not very disturbing, since the form of the insole generally corresponds approximately to the projection of the foot on the shoe bottom and the edge of the insole hardly serves for support of the foot.

Cushion soles are also known (see, for example, U.S. Pat. Nos. 532,429 and 1,559,532) in which honeycomb air cushion inserts are provided in heel and forefoot regions of an insole or outsole. In these cushion soles, the peripheral cells of the insert are closed at their side edges; however, the ends of the cells are open and the insert is disposed in or on another sole layer to produce an air cushion effect. Also, the cells or partial cells at the periphery of the cushion inserts are smaller than the other cells, which are all of the same size.

With known honeycomb structures, since all of the honeycomb cells are designed in the same way, except at the edge area, the damping and restoring force is essentially uniform, except at an edge or narrow peripheral area.

SUMMARY OF THE INVENTION

Thus, a primary object of this invention is that of achieving a more favorable cushioning in the area of the heel, and at the same time, a good guiding of the heel or the heel bone in a shoe, especially a sport shoe or rehabilitation shoe.

This object is achieved by the honeycomb body being provided in an area under the heel bone and by the honeycomb cells in a central portion of the honeycomb body having a greater surface area, when seen in top view, than honeycomb cells surrounding the central portion in a manner such that the cells progressively decrease, either stepwise or continuously, in a radial direction.

The greater surface area of the honeycomb cells present in the center of the heel results in a higher damping effect there than on the surrounding collar or heel edge. This has the advantage that, in walking, the lower convexly curved central area of the heel bone is, first, greatly damped, until the honeycomb cells surrounding the center help support the heel bone or heel with greater stiffness. The central part of the honeycomb body, thus, represents the actual damping part, while the edge area surrounding it, with the honeycomb cells of smaller surface area acting as a support for the heel edge part having a controllable stiffness or restoring force. Furthermore, the progressive change in the support provided, especially by arranging the cells in rings around the center of the heel, with the cells being elongated in a circumferential direction, produces a cupping effect that optimizes guidance of the heel bone.

BRIEF DESCRIPTION OF THE DRAWINGS

FIG. 1 is a top view of a honeycomb body insert provided for arrangement under the heel bone in an enlarged representation;

FIG. 2 is a schematic diagram of the honeycomb body of FIG. 1 seen from the side;

FIG. 3 is a cross-sectional view of an insert section with honeycomb walls of varying thickness;

DETAILED DESCRIPTION OF THE PREFERRED EMBODIMENT

Figure 4:
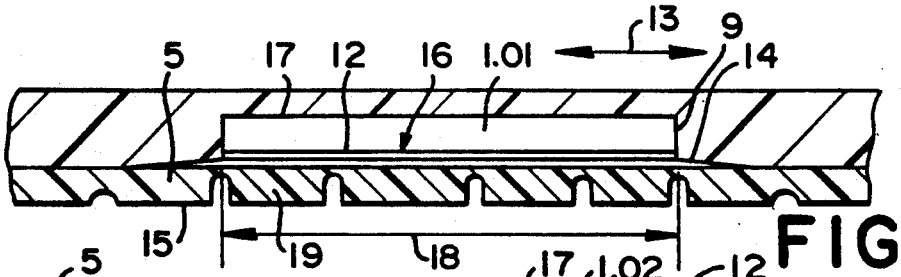
FIG. 4 is a partial segment of a longitudinal section of the sole taken along line 4—4 in FIG. 6 with a honeycomb body insert in the forefoot area shown in elevation.

In FIG. 1, a honeycomb body is identified by 1, which is designed as a plate-shaped insert that is approximately round or oval in top view, for example, and according to FIG. 2, is placed in an area 2 under a heel bone 3 of a wearer. The honeycomb body 1 is located in a recess 4 of a sole 5, preferably, in a damping midsole of a shoe, especially a sport shoe or rehabilitation shoe.

According to the invention, honeycomb cells 6.1 in the center area 7 have a greater surface area than the honeycomb cells 6.2 coaxially surrounding center area 7 of honeycomb body 1, which is under the deepest point 8 of heel bone 3. The arrangement can be selected so that the surface area of the honeycomb cells, seen in top view, decreases continuously or in steps from center 7, so that honeycomb body insert 1 becomes increasingly stiffer toward edge 9. An increase of the stiffness toward edge 9, optionally, can also be achieved in that, besides the surface area, the stability of honeycomb walls 10 is changed toward peripheral edge 9 so that the stiffness of honeycomb walls 10 becomes greater in a radially outward direction. This can take place, for example, by enlarging the wall thickness of the honeycomb walls toward edge 9, as represented in FIG. 3.

Honeycomb body 1 consists of an elastic, compressible material, for example of polyethylene, polyurethane, polyether or the like and can be produced, for example, by an injection molding process or can be a disk cut from an extruded product. Honeycomb body 1, is initially open at top and bottom, but when inserted into recess 4 of the sole or midsole 5, an upper covering layer formed, preferably, by the insole, and a lower covering layer 12 formed, preferably, by the outsole, can close the individual honeycomb cells practically gastight. However, preferably, the cells of the honeycomb body 1 are already closed tight, especially gastight, at the top and/or bottom of the honeycomb body by its own covering layer 11, 12.

To avoid the initially described negative effect of laterally open edge honeycomb cells, honeycomb cells 6.3 in outermost honeycomb row 10 are designed as honeycomb cells surrounded on all sides by cell walls 11.

According to an advantageous configuration of the invention represented in FIGS. 4 to 8, honeycomb body 1, at peripheral edge 9, is provided with an edge flange 14 that projects from edge 9 in the directions 13, parallel to the plane of the sole. Sole 5 is comprised of am insole 5*a* and an outsole 5*b*, with the honeycomb body 1 being received in a recess within the midsole 5*a* and solidly bonded, for example, vulcanized, glued or hot-sealed, to outsole 5*b* by this edge flange 14. The production takes place, for example, so that the side 16 of honeycomb body 1 which faces tread surface 15 of outsole 5*b* is provided with a cover layer 12, or this cover layer 12 is co-molded in the production of honeycomb body 1 and this honeycomb body 1 is inserted in a sole injection mold. In the injection molding of sold 5, the sole material is boned to the material of edge flange 14. In this way, a one-piece, practically homogeneous sole 5 is obtained from different molded parts.

As materials for sole 5, honeycomb body 1 and cover layer 12, preferably similar materials are used which bond well to one another. For example, these sole parts are made of rubber, a rubber-plastic mixture or plastic. With a sufficiently thick cover layer 12, it can serve directly as part of thread surface 15. In this case, sole 5, produced in the sole injection mold, has a recess 17 in midsole 5*a*, which is not filled with sole material.

Figure 5:
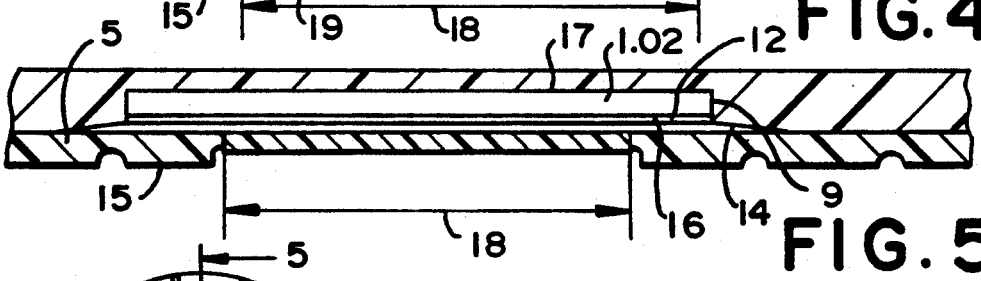
FIG. 5 is a partial segment of a longitudinal section of the sole taken along line 5—5 in FIG. 6 with a honeycomb body insert in the heel area shown in elevation.

In the embodiments according to FIGS. 4 and 5, cover layer 12 is covered by sole material and these sole parts are solidly bonded to one another, for example, by vulcanization, especially by suitable selection of the materials of sole 5 and cover layer 12.

Figure 6:
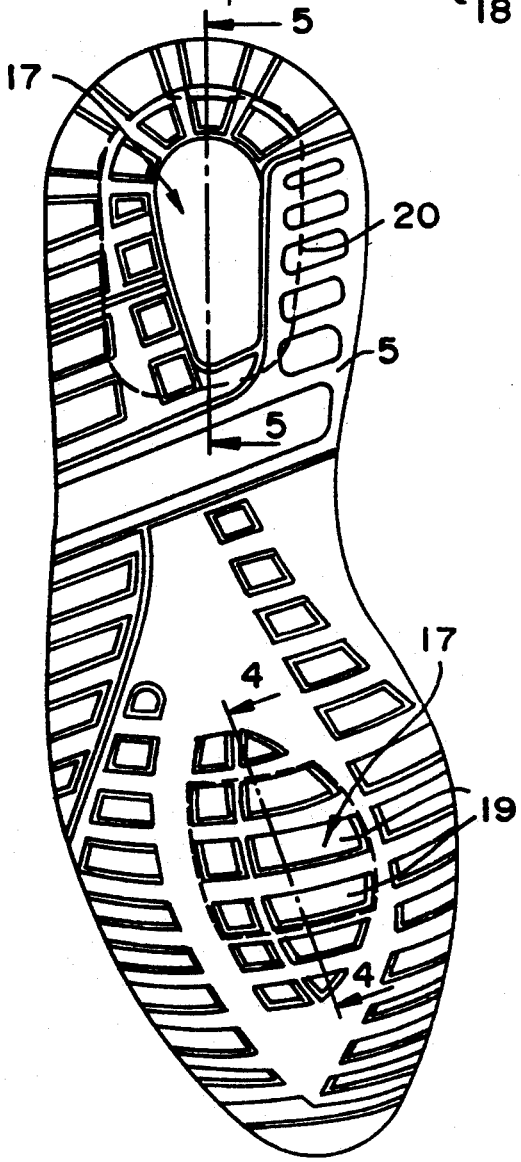
FIG. 6 is a view of the tread surface of the sole.
Figure 8:
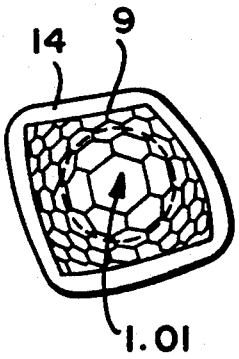

In the embodiment represented in FIG. 4, which shows a segment of a longitudinal section in the forefoot area of the sole of FIG. 6, the surface of area 18 of sole 5 corresponds precisely to the surface area of honeycomb body 1.01 the periphery of which is—and after "represented" insert—by a broken line in the forefoot area of the sole in FIG. 6 and which is shown in greater detail represented in FIG. 8. In area 18, sole material is formed on cover layer 12 in the form of gripping elements 19. Preferably, transparent material is used for cover layer 12 and the sole 5 in area 18, so that the structure of honeycomb body 1 is visible from the outside. In this way, it can immediately be determined for which type of running of a user a shoe with such a sole 5 is suitable.

Figure 7:
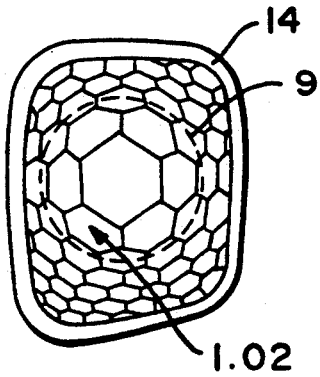
FIGS. 7 and 8 are views top plan of a respective honeycomb body for each of the forefoot and heel area.

Honeycomb body 1 can also be greater than recess 17 or area 18, as represented by FIG. 5. FIG. 5 shows a longitudinal section of a segment of the heel area of FIG. 6. Area 18 is smaller in area than the surface area of honeycomb body 1.02 as shown in FIG. 7, the area of honeycomb 1.02 also being represented lines by broken peripheral surface line 20 in FIG. 6, in the heel area. Area 18, in this case, is not provided with gripping elements and the outer surface of outsole 5*b* is recessed inwardly relative to the outer surface of tread surface 15. In this way, an increased damping is achieved.

It has turned out to be advantageous to coordinate the degree of hardness of honeycomb body 1, sole 5 and area 18 of sole 5 to one another, and to select a material for cover layer 12 or the sole material covering it which is the softest and for the honeycomb body 1 which is the hardest. The following were determined as advantageous degrees of hardness for the individual materials:

Honeycomb body: Shore A about 63 to 65,

Sole: Shore A about 60,

Cover layer or sole material covering it: Shore A about 56 to 58.

The shoe according to the invention can especially be used as a sport shoe, preferably for all types of sports, in which a favorable cushioning and at the same time a good guiding of the heel or the heel bone matter. This includes the wide range of use of training and jogging shoes, as well as the area of special sport shoes, for example, jumping shoes, hurdle shoes, sprint shoes, pole vaulting shoes or the like.

Since the pressure action in the area of the heel bone is purposefully reduced, the shoe designed according to the invention is also suitable as a rehabilitation shoe, namely, especially in the case of heel bone injuries which are healing, since the cushioning in the central area of the heel can be adjusted so that a troublesome pressure action on the heel bone is avoided.

By varying of the parameters of the surface area of the honeycomb bodies 6.1 in central area 7 and changing of the stability of honeycomb walls 10, the pressure action on the heel bone and guiding of the heel bone can be optimized depending on the field of use of the shoe according to the invention. Furthermore, the configuration shown, most clearly, in FIGS. 1, 7 and 8 adds to the optimization of guidance of the convexly curved central area of &:he heel bone of the wearer by creating an enhanced cupping effect. This cupping effect is traceable to the honeycomb cells being arranged in rings about a largest central cell with the cells of the rings being elongated in a circumferential direction. More specifically, such an arrangement provides a greater ability for the cells deform circuferentially (which facilitates a tendency of the honeycomb body to wrap about the heel bone) than to deform radially (which produces a lesser tendency for the rings to be pushed inwardly by the heel bone).

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

I claim:

1. A shoe comprising at least one sole layer with at least one insert part in the form of a honeycomb body made of elastic compressible material, and having honeycomb cells with central axes running at least approximately perpendicular to a plane parallel to said sole layer; wherein the honeycomb body is provided in the sole layer in an area positioned under the heel bone of the wearer; and wherein the surface area of the honeycomb cells progressively decreases in radial directions outwardly from a center area of the honeycomb body toward a peripheral area of the honeycomb body.

2. Shoe according to claim 1, wherein the progressive decrease in the surface area of the honeycomb cells occurs continuously.

3. Shoe according to claim 1, wherein the honeycomb body has a cover layer on a side facing a tread surface of the sole; wherein an edge of the honeycomb body has a peripheral edge flange which projects parallel to said plane; and wherein the edge flange is solidly bonded to the sole.

4. Sole according to claim 4, wherein an area of the sole covering at least part of the cover layer is transparent.

5. Shoe according to claim 4, wherein the surface area of the honeycomb body is greater than that of the transparent area of the sole.

6. Shoe according to claim 5, wherein the sole has gripping elements molded on an area covering the honeycomb body.

7. Shoe according to claim 3, wherein the honeycomb body is formed of a material whose degree of hardness is greater than that of the sole layer and cover layer; and wherein the cover layer has a degree of hardness which is less than that of sole layer.

8. Shoe according to claim 7, wherein the material of the honeycomb body has a degree of hardness of about Shore A 63 to 65, the material of sole layer has a degree of hardness of about Short A 60 and the material of the cover layer has a degree of hardness of about Shore A 56 to 58.

9. Shoe according to claim 3, wherein the honeycomb body is disposed in a midsole layer and said flange is bonded to an outsole layer.

10. Sole according to claim 4, wherein the sole layer extends over the entire cover layer and is solidly bonded to the cover layer.

11. Shoe according to claim 10, wherein the honeycomb body and the sole layer are formed of similar materials which are able to be bonded to one another by a molding process.

12. Shoe according to claim 1, wherein the honeycomb body and the sole layer are formed of similar materials which are able to be bonded to one another by a molding process.

13. Shoe according to claim 1, wherein the sole has gripping elements molded on an area covering the honeycomb body.

14. Shoe according to claim 1, wherein a wall thickness of walls defining the honeycomb cells increases in correspondence with the decrease of the surface area of honeycomb cells.

15. Shoe according to claim 1, wherein the honeycomb cells are least approximately gastight.

16. Shoe according to claim 1, wherein honeycomb cells are completely gastight.

17. Shoe according to claim 1, wherein, as a means for producing a cupping effect relative to the heel bone of the wearer, the honeycomb cells are arranged in rings about a largest central cell.

18. Shoe according to claim 17, wherein the honeycomb cells in the rings are elongated in a circumferential direction about the largest central cell.

19. Shoe according to claim 1, wherein the honeycomb body is disposed in a midsole layer.

* * * * *